US008836539B2

(12) United States Patent
Lee

(10) Patent No.: US 8,836,539 B2
(45) Date of Patent: Sep. 16, 2014

(54) COMBINED LOOP TYPE AUTO-MOBILE SENSOR USING LOOP COIL AND PARKING INFORMATION SYSTEM THE SAME

(75) Inventor: Jeong Jun Lee, Gunpo-si (KR)

(73) Assignee: Moru Inven Co., Ltd., Gunpo-Si (KR)

( * ) Notice: Subject to any disclaimer, the term of this patent is extended or adjusted under 35 U.S.C. 154(b) by 901 days.

(21) Appl. No.: 12/994,635

(22) PCT Filed: Jul. 17, 2008

(86) PCT No.: PCT/KR2008/004197
§ 371 (c)(1),
(2), (4) Date: Nov. 24, 2010

(87) PCT Pub. No.: WO2009/145384
PCT Pub. Date: Dec. 3, 2009

(65) Prior Publication Data

US 2011/0074605 A1 Mar. 31, 2011

(30) Foreign Application Priority Data

May 27, 2008 (KR) ..... 10-2008-0049164

(51) Int. Cl.
*G08G 1/01* (2006.01)

(52) U.S. Cl.
USPC ..... 340/941; 340/932.2; 340/933; 324/239; 324/207.17; 324/225; 324/228

(58) Field of Classification Search
USPC ..... 340/932.2–933, 941; 324/239, 207.17, 324/225, 228
See application file for complete search history.

(56) References Cited

U.S. PATENT DOCUMENTS

| | | | | | |
|---|---|---|---|---|---|
| 4,024,468 | A | * | 5/1977 | Hirschi | 324/329 |
| 4,383,239 | A | * | 5/1983 | Robert | 340/933 |
| 4,486,710 | A | * | 12/1984 | Schmidt | 324/179 |
| 5,001,425 | A | * | 3/1991 | Beling et al. | 324/239 |
| 5,426,363 | A | * | 6/1995 | Akagi et al. | 324/239 |
| 5,432,444 | A | * | 7/1995 | Yasohama et al. | 324/240 |
| 5,757,288 | A | * | 5/1998 | Dixon et al. | 340/941 |
| 6,147,624 | A | * | 11/2000 | Clapper | 340/932.2 |

(Continued)

FOREIGN PATENT DOCUMENTS

| | | | |
|---|---|---|---|
| JP | 10172092 | A | 6/1998 |
| KR | 10-2006-0055150 | A | 5/2006 |
| KR | 10-2007-0109480 | A | 11/2007 |

OTHER PUBLICATIONS

International Search Report for International Patent Application No. PCT/KR2008/004197.

*Primary Examiner* — Daniel Wu
*Assistant Examiner* — Son M Tang

(57) ABSTRACT

Provided are a loop type automobile sensing device formed integrally with a small loop coil, which has the automobile sensing sensitivity of a related art loop type automobile sensing device using a large loop coil, so as to greatly facilitate installing and maintaining of the loop type automobile sensing device and to expand the application scope of the loop type automobile sensing device, and a parking information system using the loop type automobile sensing device. In addition, the loop type automobile sensing device integrally formed with the loop coil is provided in plurality as automobile sensors to detect the presence and moving state of an automobile according to a signal from the automobile sensors, to control operations of a plurality of cameras, warning lamps, and display devices installed to a parking lot, and to notify parking information and automobile movement information.

23 Claims, 13 Drawing Sheets

(56) References Cited

U.S. PATENT DOCUMENTS

| | | | | |
|---|---|---|---|---|
| 6,340,935 | B1 * | 1/2002 | Hall | 340/932.2 |
| 6,529,008 | B1 * | 3/2003 | Mohamed | 324/345 |
| 6,577,246 | B1 * | 6/2003 | Handa et al. | 340/901 |
| 6,865,518 | B2 * | 3/2005 | Bertrand et al. | 702/189 |
| 6,885,311 | B2 * | 4/2005 | Howard et al. | 340/932.2 |
| 6,970,101 | B1 * | 11/2005 | Squire et al. | 340/932.2 |
| 7,002,487 | B1 * | 2/2006 | Montgomery, Sr. | 340/932 |
| 7,014,355 | B2 * | 3/2006 | Potter et al. | 368/90 |
| 7,474,233 | B2 * | 1/2009 | Ponert | 340/941 |
| 7,495,351 | B2 * | 2/2009 | Fein et al. | 290/1 R |
| 7,525,210 | B2 * | 4/2009 | Fein et al. | 290/44 |
| 7,868,784 | B2 * | 1/2011 | Kuo et al. | 340/932.2 |
| 8,108,055 | B2 * | 1/2012 | Wong | 700/1 |
| 8,150,639 | B2 * | 4/2012 | Ikkink et al. | 702/57 |
| 8,390,477 | B2 * | 3/2013 | Noel, II | 340/941 |
| 2003/0128136 | A1 * | 7/2003 | Spier et al. | 340/932.2 |
| 2005/0035880 | A1 * | 2/2005 | Roland | 340/941 |
| 2006/0170566 | A1 * | 8/2006 | Slemmer et al. | 340/932.2 |
| 2006/0212344 | A1 * | 9/2006 | Marcus et al. | 705/13 |
| 2011/0254703 | A1 * | 10/2011 | Li et al. | 340/944 |

* cited by examiner

FORM OUTLINE AT INSTALL REGION IN ROAD

CUT AUTOMOBILE SENSOR HEAD/LEAD-IN

REMOVE FOREIGN SUBSTANCES AND WATER FROM CUT PORTION AND DRY CUT PORTION

INSTALL LOOP COIL IN CUT PORTION (HEAD/LEAD-IN)

INJECT SEALANT INTO CUT PORTION

REMOVE SEALANT FLOWING OUT OF CUT PORTION AND CLEAN SURROUNDING

ENTRANCE OF PARKING LOT

COMBINED LOOP TYPE AUTO-MOBILE SENSOR USING LOOP COIL AND PARKING INFORMATION SYSTEM THE SAME

CROSS REFERENCE TO RELATED APPLICATION

This application is a National Stage of International Application No. PCT/KR2008/004197 filed Jul. 17, 2008, claiming priority based on Korean Patent Application No. 10-2008-0049164 filed May 27, 2008, the content of which is incorporated herein by reference in its entirety.

TECHNICAL FIELD

The present invention relates to an integral loop type automobile sensing device including a small loop coil, and a parking information system using the loop type automobile sensing device, and more particularly, to a loop type automobile sensing device integrally formed with a loop coil, which significantly improves a related art loop type automobile sensor having limitations such as complicated installation, road cutting, short circuiting of a connection wire between a loop coil and the automobile sensor during maintenance, and difficulty in recycling the previous loop coil when repaving a road, and a parking information system using the integral loop type automobile sensing device.

BACKGROUND ART

For several decades, loop type automobile sensing devices have been most widely used all over the world. Such a loop type automobile sensing device includes a loop coil installed in a cut portion of a road, and a loop sensor connected to the loop coil through a lead wire to detect the presence of an automobile through inductance variation, so as to detect traffic information on the presence, speeds and types of automobiles. This is because inductance variation of a loop coil is not affected by road icing, temperature/humidity variation, sunshine variation, and road surface conditions, and has a reliability of 99% or more in actual use. A loop type automobile sensing device detects inductance variation that is generated at a loop coil by the movement of an automobile to detect information on the presence, speeds and types of automobiles.

FIG. 1 is a schematic view illustrating an install state of a related art loop type automobile sensing device. Referring to FIG. 1, the loop type automobile sensing device includes a loop coil 1 that is embedded in a cut portion of a lane or region to be sensed, a loop sensing device 5, a lead line 3 connecting the loop coil 1 to the loop sensing device 5, and a controller 6 for using automobile sensing information.

FIG. 2 is a schematic view illustrating install states of related art loop coils. The loop coils include an 8-corner loop coil 25, a 32-angle loop coil 26, and a circular loop coil 27 that have a size of 1.8 m×1.8 m, a size of 4.0 m×1.8 m, and a diameter of 1.8 m, respectively.

FIGS. 3*a* through 3*f* are images illustrating a process of installing a related art loop coil in a road.

First, an outline is formed at an install region of a loop coil in a road as illustrated in FIG. 3*a*. Then, an automobile sensor head/lead-in is cut as illustrated in FIG. 3*b*. Then, foreign substances and water are removed from a cut portion and the cut portion is dried as illustrated in FIG. 3*c*. Then, the loop coil is installed in the cut portion as illustrated in FIG. 3*d*. Then, sealant is injected into the cut portion as illustrated in FIG. 3*e*. Finally, sealant flowing out of the cut portion is removed and the surrounding is cleaned to complete the process as illustrated in FIG. 3*f*.

FIG. 4 is a schematic view illustrating an install state of a related art loop type automobile sensing device for sensing an automobile, and an install state of a camera applied to a nonpayment prevention system of a parking lot or a toll gate, a signal/speed enforcement camera, and a license plate recognition camera.

Referring to FIG. 4, the loop type automobile sensing device includes a loop coil 1 for sensing an automobile, a camera 19 for photographing an automobile, a loop sensing device (not shown) receiving a signal sensed at the loop coil 1 through a lead line 3, and the controller 6. The controller 6 detects speed violation or signal violation using a signal sensed at the loop sensing device, commands the camera 19 to form an image of a violation automobile, and processes the image.

The most characterized performance of the loop type automobile sensing device is its automobile sensing sensitivity. Much research shows that the automobile sensing sensitivity largely depends on the size of a loop coil and that the length of the minimum side of the closed loop coil is proportional to a sensing height. As a result, a standard loop coil has a small side of about 1.8 m in Korea (8-corner type: 1.8 m×1.8 m, 32-corner type: 4 m×1.8 m, circular type: diameter of 1.8 m).

Based on a relationship between loop coil size and automobile sensing sensitivity, a related art loop type automobile sensing device should have a predetermined size to maintain a desired automobile sensing sensitivity, which makes an install process complicated, thereby increasing install process time and costs.

In addition, since a road should be cut when installing a loop coil, the road is damaged. Further, after a road is repaved, an embedded loop coil is not recycled, thereby requiring additional costs. A frequent construction of a side of a road causes short circuiting of a connection wire between a loop coil and an automobile sensing device.

Referring to FIG. 5, after a loop type automobile sensing device 10 is installed on a side of a road, gas, electricity, and communication line constructions and road maintenance are frequently performed along an edge 11 of the road to cause short circuiting of a connection wire between the loop coil 1 installed in a lane and the loop type automobile sensing device 10 disposed at the side of the road. Thus, the life cycle of the loop type automobile sensing device 10 is very short. These limitations are common to related art methods of connecting the lead line 3 of the loop coil 1 to the loop type automobile sensing device 10 installed at the side of the road. As such, because of short circuiting of the lead line 3 between the loop coil 1 and the loop type automobile sensing device 10, equipment installed at an enormous cost becomes useless, thus significantly increasing social costs.

When modifying and maintaining a road including the loop coil 1, the thickness of the road is increased to decrease the automobile sensing sensitivity. In addition, the loop coil 1 is frequently broken down by careless modification and maintenance, thereby significantly increasing social costs.

DISCLOSURE

Technical Problem

An object of the present invention is to provide a loop type automobile sensing device formed integrally with a small loop coil, which has the automobile sensing sensitivity of a related art loop type automobile sensing device using a large loop coil, so as to greatly facilitate installing and maintaining of the loop type automobile sensing device and to expand the application scope of the loop type automobile sensing device, and a parking information system using the loop type automobile sensing device.

Another object of the present invention is to provide a loop type automobile sensing device integrally formed with a small loop coil having a maximized sensing sensitivity, which is simply attached to a road without performing a complicated process of installing a loop coil in a road, and a parking information system using the loop type automobile sensing device.

Another object of the present invention is to provide a loop type automobile sensing device integrally formed with a small loop coil, which addresses a limitation that a necessary road excavation work, such as gas, electricity, communication line constructions, causes short circuiting of an connection wire between a loop coil and a loop type automobile sensing device, and a parking information system using the loop type automobile sensing device.

Another object of the present invention is to a loop type automobile sensing device integrally formed with a loop coil, which is recyclable after repaving a road, and a parking information system using the loop type automobile sensing device.

Another object of the present invention is to a loop type automobile sensing device integrally formed with a loop coil, which is provided in plurality as automobile sensors to detect the presence and moving state of an automobile according to a signal from the automobile sensors, to control operations of a plurality of cameras, warning lamps, and display devices installed to a parking lot, and to notify parking information and automobile movement information, and a parking information system using the loop type automobile sensing device.

Another object of the present invention is to a loop type automobile sensing device integrally formed with a loop coil, which includes a display unit for displaying the presence of an available parking space, and a parking information system using the loop type automobile sensing device.

Another object of the present invention is to a loop type automobile sensing device integrally formed with a loop coil, which includes a solar panel to convert solar energy supplied through the solar panel into electrical energy to supply power, and a parking information system using the loop type automobile sensing device.

Technical Solution

According to an embodiment of the present invention, an integral loop type automobile sensing device includes: a body providing an appearance; a loop coil having a closed curve along a periphery surface in the body; an inductance evaluation unit configured to receive, from the loop coil, electrical variation induced by an automobile to increase signal sensitivity; and a communication unit configured to receive an automobile sensing result from the inductance evaluation unit and to transmit the result.

According to another embodiment of the present invention, an integral loop type automobile sensing device includes: a body providing an appearance; two or more differential loop coils having closed curves in the body and arranged in an up-and-down direction to have different distances from a lower structure of a target automobile; an inductance evaluation unit configured to receive, from the loop coil, electrical variation induced by the automobile to increase automobile sensing sensitivity; and a communication unit configured to receive an automobile sensing result from the inductance evaluation unit and to transmit the result.

At least one of the loop coils may be disposed along a periphery surface in the body to have a maximum closed curve.

The inductance evaluation unit may be configured to increase the automobile sensing sensitivity using a variation difference between the loop coils arrayed in the up-and-down direction to have different distances from a lower structure of a target automobile.

The integral loop type automobile sensing device may further includes a magnetometer circuit unit having at least one axis that selectively or simultaneously uses a signal transmitted from the inductance evaluation unit and a signal transmitted from the magnetometer circuit unit to provide state information about an automobile.

The inductance evaluation unit may include a low pass filter (LPF) at a front end of a counter input therein to reduce zitter when a signal is transmitted, and to improve the automobile sensing sensitivity.

The loop coil may have a size of 900 mm or less.

The inductance evaluation unit may adjust a counter driving frequency therein to increase the automobile sensing sensitivity.

The inductance evaluation unit may adjust a period for evaluating inductance variation therein to increase the automobile sensing sensitivity.

The integral loop type automobile sensing device may further include a battery power unit to supply power for operating the integral loop type automobile sensing device.

The communication unit may perform one-to-one communication or one-to-many communication through wired communication or wireless communication.

The body may be formed in a single piece.

The body may be fixed to a road surface through a screw member or a nail member.

The body may be embedded in a road such that an upper surface of the body is flush with a road surface, and then the body may be fixed to the road through a screw member or a nail member.

The body may include two pieces that are removable from each other.

The body may be fixed to a road surface through a screw member or a nail member.

The body may be embedded in a road such that an upper surface of the body is flush with a road surface, and then the body may be fixed to the road through a screw member or a nail member.

The integral loop type automobile sensing device may receive power through a power connection wire from a photovoltaic device that includes a solar panel installed at a dividing line of a road or at a safety zone.

The integral loop type automobile sensing device may further include a photovoltaic device that converts photo energy, supplied through a solar panel installed to an upper part of the body, into electrical energy to supply power.

According to still another embodiment of the present invention, a parking information system using a plurality of integral loop type automobile sensing devices as automobile sensors disposed at a parking lot floor, each including: a body providing an appearance; a loop coil having a closed curve along a periphery surface in the body; an inductance evaluation unit configured to receive, from the loop coil, electrical variation induced by an automobile to increase signal sensitivity; and a communication unit configured to receive an automobile sensing result from the inductance evaluation unit and to transmit the result, includes a control unit configured to detect parking and moving state of an automobile according to a signal transmitted from the automobile sensors, to control operations of a plurality of cameras, warning lamps, and display devices installed to a parking lot, and to notify parking information and automobile movement information.

According to still further another embodiment of the present invention, a parking information system using a plurality of integral loop type automobile sensing devices as automobile sensors disposed at a parking lot floor, each including: a body providing an appearance; two or more differential loop coils having closed curves in the body and arranged in an up-and-down direction to have different distances from a lower structure of a target automobile; an inductance evaluation unit configured to receive, from the loop coil, electrical variation induced by the automobile to increase automobile sensing sensitivity; and a communication unit configured to receive an automobile sensing result from the inductance evaluation unit to transmit the result, includes a control unit configured to detect parking and moving state of an automobile according to a signal transmitted from the automobile sensors, to control operations of a plurality of cameras, warning lamps, and display devices installed to a parking lot, and to notify parking information and automobile movement information.

At least one of the loop coils may be disposed along a periphery surface in the body to have a maximum closed curve.

The inductance evaluation unit may be configured to increase the automobile sensing sensitivity using a variation difference between the loop coils arrayed in the up-and-down direction to have different distances from a lower structure of a target automobile.

The parking information system may further include a battery power unit to supply power for operating the integral loop type automobile sensing device.

The communication unit may perform one-to-one communication or one-to-many communication through wired communication or wireless communication.

The integral loop type automobile sensing device may receive power through a power connection wire from a photovoltaic device that includes a solar panel installed at a dividing line of a road or at a safety zone.

The integral loop type automobile sensing device may include a display unit installed at a side of the body to display presence of an available parking space.

The integral loop type automobile sensing device may include a photovoltaic device that converts photo energy, supplied through a solar panel installed to an upper part of the body, into electrical energy to supply power.

The integral loop type automobile sensing device may include: a display unit installed at a side of the body to display presence of an available parking space; and a photovoltaic device that converts photo energy, supplied through a solar panel installed to an upper part of the body, into electrical energy to supply power.

Advantageous Effects

Each of related art loop type automobile sensing devices requires cutting of a road, which damages the road. After the loop type automobile sensing devices are installed, gas, electricity and communication line constructions and road maintenance are frequently performed on an edge of a road. This frequently causes short circuiting of a connection wire between a loop coil installed the road and a loop sensing device installed the side of the road. Thus, a loop coil and an automobile sensing device are broken down, and costs for repairing short circuiting of a connection wire between a loop coil and an automobile sensing device are increased.

However, in a loop type automobile sensing device integrally formed with a loop coil and a parking information system using the loop type automobile sensing device according to the present invention, since the loop type automobile sensing device is integrally formed with the loop coil, a complicated road cutting process for installing a loop coil is not required, thus facilitating an install process and reducing install costs.

In addition, since the loop type automobile sensing device is integrally formed with the loop coil, a limitation that a lead line is cut between an automobile sensing device and a loop coil is overcome, and the life cycle and reliability of an automobile sensing device are secured.

Further, the integral automobile sensing device is removed in road re-pavement or construction after installing a loop coil, and the removed automobile sensing device can be recycled after the road re-pavement or construction, thereby reducing additional costs.

Moreover, since the loop type automobile sensing device according to the present invention can be applied to any field that employs a related art loop type automobile sensor, costs required for installing a related art loop type automobile sensing device are significantly reduced.

Furthermore, the loop type automobile sensing device integrally formed with the loop coil is provided in plurality as automobile sensors at a floor of a parking lot to detect the presence and moving state of an automobile according to a signal from the automobile sensors, to control operations of a plurality of cameras, warning lamps, and display devices installed to a parking lot, and to notify parking information and automobile movement information.

MODE FOR INVENTION

Hereinafter, embodiments of the present invention will now be described with reference to the accompanying drawings.

[Embodiment]

Figure 6:
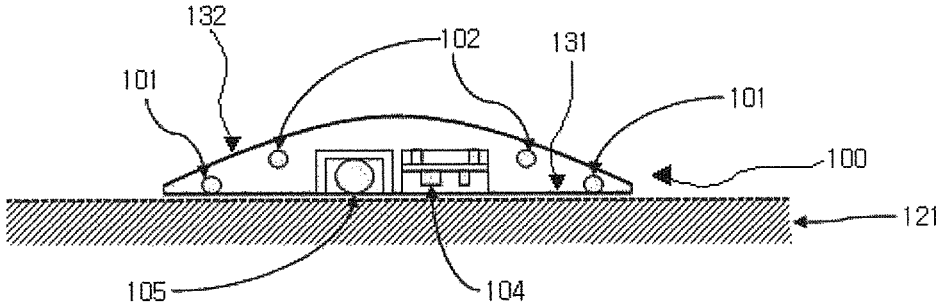
FIG. 6 is a schematic view illustrating a protruding loop type automobile sensing device according to an embodiment.
Figure 6:
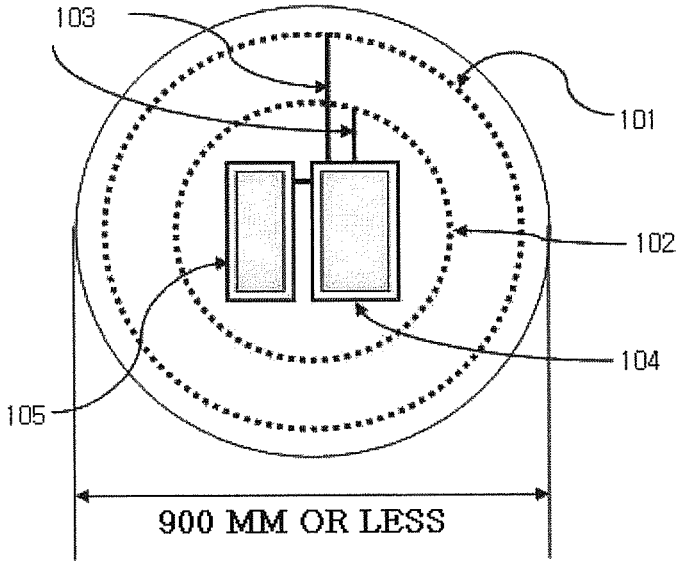

FIG. 6 is a schematic view illustrating a protruding loop type automobile sensing device according to an embodiment.

Referring to FIG. 6, a protruding loop type automobile sensing device 100 includes a primary loop coil 101, a secondary loop coil 102, an inductance evaluation unit 104, and a communication unit 105. The primary loop coil 101 has the maximum closed surface along the most outer boundary of a wide surface of an integral automobile sensing device structure (body). The secondary loop coil 102 is configured to make a distance, between a lower structure of a target automobile (not shown) and the secondary loop coil 102, different from a distance between the lower structure of the target automobile and the primary loop coil 101, so as to have a different sensing sensitivity from that of the primary loop coil 101. The inductance evaluation unit 104 is configured to receive, from the primary loop coil 101 and the secondary loop coil 102, electrical variations induced by an automobile to improve automobile sensing sensitivity using a characteristic difference between the electrical variations. The communication unit 105 transmits a vehicle sensing result evaluated from the inductance evaluation unit 104. The primary loop coil 101 and the secondary loop coil 102 are electrically connected to the inductance evaluation unit 104 through loop connection wires 103.

The primary loop coil 101 may be disposed along a periphery surface in the body to have the maximum closed surface.

The inductance evaluation unit 104 is configured to improve the automobile sensing sensitivity using a variation difference between the primary loop coil 101 and the secondary loop coil 102 that are arranged in the up-and-down direction to make a distance, between a lower structure of a target automobile and the secondary loop coil 102, different from a distance between the lower structure of the target automobile and the primary loop coil 101.

When the loop type automobile sensing device 100 is installed on a steel structure, a vehicle sensing signal (result) transmitted from the loop coil is weak. To address this limitation, the loop type automobile sensing device 100 includes a magnetometer circuit unit (not shown) having at least one axis to selectively or simultaneously use a signal received from the inductance evaluation unit 104 and a signal received from the magnetometer circuit unit so as to provide state information about an automobile.

The sizes of the primary loop coil 101 and the secondary loop coil 102 are about 50% (about 900 mm) or less of 1.8 m that is the size of a related art loop coil and have more improved sensitivity than a related art loop coil. To this end, the inductance evaluation unit 104 includes a low pass filter (LPF) (not shown) at the front end of a counter input therein, so as to reduce zitter when a signal is transmitted, thereby improving the automobile sensing sensitivity.

Alternatively, a counter driving frequency in the inductance evaluation unit 104 may be improved to increase the automobile sensing sensitivity of the primary loop coil 101 and the secondary loop coil 102.

Alternatively, a period for evaluating inductance variation in the inductance evaluation unit 104 may be sufficiently extended to increase the automobile sensing sensitivity of the primary loop coil 101 and the secondary loop coil 102.

The communication unit 105 performs one-to-one communication or one-to-many communication through wired communication or wireless communication.

The body of the loop type automobile sensing device 100 is a single element or includes two separated elements. The body is fixed onto a road surface 121 through a screw member or a nail member.

The loop type automobile sensing device 100 may receive power through a power connection wire (refer to 113 of FIG. 13) from a photovoltaic device (refer to 117 of FIG. 13) including a solar panel that is installed at a dividing line of a road or a safety zone.

The loop type automobile sensing device 100 may receive power from a photovoltaic device (not shown) that converts photo energy, supplied through a solar panel (refer to 115 of FIG. 14) installed to the upper part of the body, into electrical energy to supply power.

The loop type automobile sensing device 100 including the primary loop coil 101 and the secondary loop coil 102 can be applied to any field that employs a related art loop type automobile sensing device provided with a loop coil and a connection wire.

The loop type automobile sensing device 100 may be fixed to the position of a road where a related art loop coil is installed and simplify a complicated install process, and thus, can be applied to any field that employs a related art loop type automobile sensing device provided with a loop coil and a connection wire.

The loop type automobile sensing device 100 includes a base plate 131 and a top cover 132. The base plate 131 has a flat lower surface to be installed on the road surface 121, and the inductance evaluation unit 104 and the communication unit 105 are installed at the base plate 131. The top cover 132 is integrally with or removably coupled to the base plate 131 and has an oval surface for providing an inner space and includes the primary loop coil 101 and the secondary loop coil 102 therein. The base plate 131 and the top cover 132 may be formed in a single piece to prevent disassembling thereof, or the base plate 131 and the top cover 132 may be removably coupled to each other. The base plate 131 and the top cover 132 may be coupled to each other through a screw member, or the base plate 131 and the top cover 132 may be coupled to each other through a screw hole member and a screw member that are integrally formed with the base plate 131 and the top cover 132. Alternatively, the base plate 131 and the top cover 132 may be fitted to each other.

According to the present invention, each of the base plate 131 and the top cover 132 is a single piece, but the base plate 131 or the top cover 132 may include at least two pieces and be removed from each other as described above.

Figure 7:
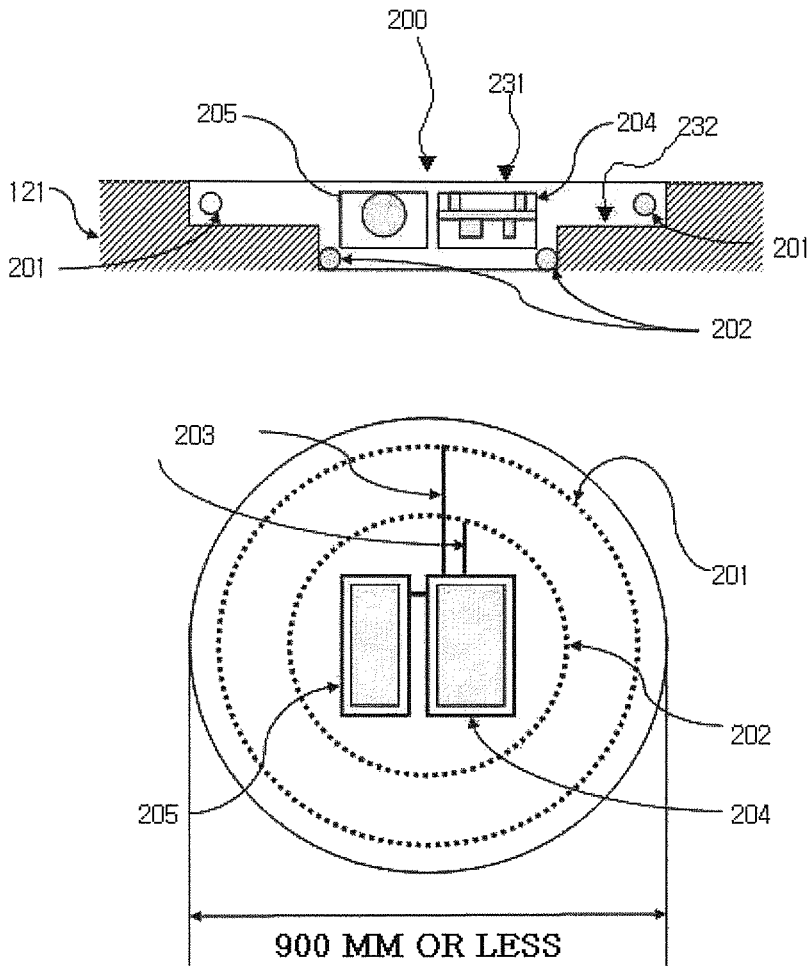
FIG. 7 is a schematic view illustrating an embedded loop type automobile sensing device according to an embodiment.

FIG. 7 is a schematic view illustrating an embedded loop type automobile sensing device according to an embodiment.

Referring to FIG. 7, an embedded loop type automobile sensing device 200 includes a primary loop coil 201, a secondary loop coil 202, an inductance evaluation unit 204, and a communication unit 205. The primary loop coil 201 has the maximum closed surface along the most outer boundary of a wide surface of an integral automobile sensing device structure (body). The secondary loop coil 202 is configured to make a distance, between a lower structure of a target automobile and the secondary loop coil 202, different from a distance between the lower structure of the target automobile and the primary loop coil 201, so as to have a different sensing sensitivity from that of the primary loop coil 201. The inductance evaluation unit 204 is configured to receive, from the primary loop coil 201 and the secondary loop coil 202, electrical variations induced by an automobile to improve the automobile-sensing sensitivity using a characteristics difference between the electrical variations. The communication unit 205 transmits a vehicle sensing result evaluated from the inductance evaluation unit 204. The primary loop coil 201 and the secondary loop coil 202 are electrically connected to the inductance evaluation unit 204 through loop connection wires 203.

The embedded loop type automobile sensing device 200 is embedded in a road such that the upper surface of the embedded loop type automobile sensing device 200 is flush with a road surface, and then the embedded loop type automobile sensing device 200 is fixed to the road through a screw member or a nail member. The embedded loop type automobile sensing device 200 is a single piece or includes two pieces that are removably coupled to each other.

When the embedded loop type automobile sensing device 200 is provided to a region where an automobile runs at a high speed, the embedded loop type automobile sensing device 200 is installed at a position where a protruding automobile sensing device may disturb the movement of an automobile or a protruding automobile sensing device may be damaged.

The primary loop coil 201 may be disposed along a periphery surface in the body to have the maximum closed surface.

The inductance evaluation unit 204 is configured to improve the automobile sensing sensitivity using a variation difference between the primary loop coil 201 and the secondary loop coil 202 that are arranged in the up-and-down direction to make a distance, between a lower structure of a target automobile and the secondary loop coil 202, different from a distance between the lower structure of the target automobile and the primary loop coil 201.

When the loop type automobile sensing device 200 is installed on a steel structure, a vehicle sensing signal (result) transmitted from the loop coil is weak. To address this limitation, the loop type automobile sensing device 200 includes a magnetometer circuit unit (not shown) having at least one axis to selectively or simultaneously use a signal transmitted from the inductance evaluation unit 104 and a signal transmitted from the magnetometer circuit unit so as to provide state information about an automobile.

The sizes of the primary loop coil 201 and the secondary loop coil 202 are about 50% (about 900 mm) or less of 1.8 m that is the size of a related art loop coil and have more improved sensitivity than a related art loop coil. To this end, the inductance evaluation unit 104 includes a low pass filter (LPF) (not shown) at the front end of a counter input therein, so as to reduce zitter when a signal is transmitted, thereby improving the automobile sensing sensitivity.

Alternatively, a counter driving frequency in the inductance evaluation unit 204 may be improved to increase the automobile sensing sensitivity of the primary loop coil 201 and the secondary loop coil 202.

Alternatively, a period for evaluating inductance variation in the inductance evaluation unit 204 may be sufficiently extended to increase the automobile sensing sensitivity of the primary loop coil 201 and the secondary loop coil 202.

The communication unit 205 performs one-to-one communication or one-to-many communication through wired communication or wireless communication.

The body of the loop type automobile sensing device 200 is a single element or includes two separated elements. The body is fixed onto the road surface 121 through a screw member or a nail member.

The loop type automobile sensing device 200 may receive power through the power connection wire (refer to 113 of FIG. 13) from the photovoltaic device (refer to 117 of FIG. 13) including a solar panel that is installed at a dividing line of a road or a safety zone.

The loop type automobile sensing device 200 may receive power from a photovoltaic device (not shown) that converts photo energy, supplied through the solar panel (refer to 115 of FIG. 14) installed to the upper part of the body, into electrical energy to supply power.

The loop type automobile sensing device 200 including the primary loop coil 201 and the secondary loop coil 202 can be applied to any field that employs a related art loop type automobile sensing device provided with a loop coil and a connection wire.

The loop type automobile sensing device 200 may be fixed to the position of a road where a related art loop coil is installed and simplify a complicated install process, and thus, can be applied to any field that employs a related art loop type automobile sensing device provided with a loop coil and a connection wire.

The loop type automobile sensing device 200 includes a base plate 231 and a bottom cover 232. The base plate 231 has an upper surface that is flush with the road surface 121 to be installed in the road surface 121. The bottom cover 232 is integrally with or removably coupled to the base plate 231 and includes the primary loop coil 201 and the secondary loop coil 202 therein. The inductance evaluation unit 204 and the communication unit 205 may be disposed at the lower portion of the base plate 231, or disposed at the bottom cover 232.

The base plate 231 and the bottom cover 232 may be formed in a single piece to prevent disassembling thereof, or the base plate 231 and the bottom cover 232 may be removably coupled to each other. The base plate 231 and the bottom cover 232 may be coupled to each other through a screw member, or the base plate 231 and the bottom cover 232 may be coupled to each other through a screw hole member and a screw member that are integrally formed with the base plate 231 and the bottom cover 232. Alternatively, the base plate 231 and the bottom cover 232 may be fitted to each other.

According to the present invention, each of the base plate 231 and the bottom cover 232 is a single piece, but the base plate 231 or the bottom cover 232 may include at least two pieces and be removed from each other as described above.

Figure 8:
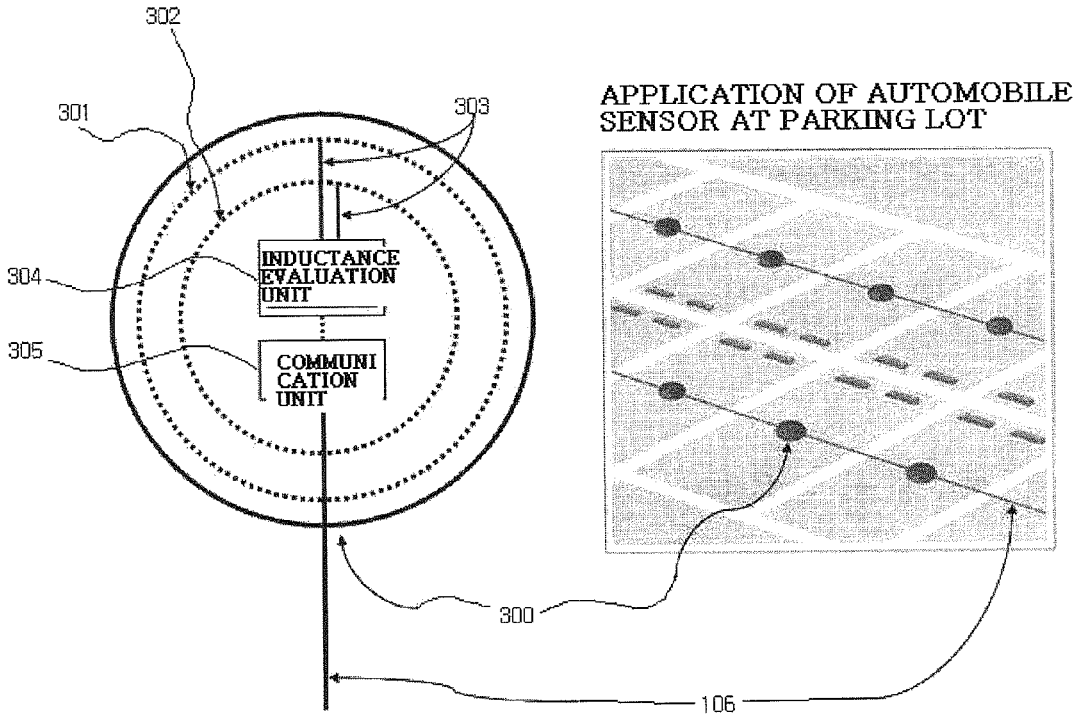
FIG. 8 is a schematic view illustrating configuration and application of a wired loop type automobile sensing device according to an embodiment.

FIG. 8 is a schematic view illustrating configuration and application of a wired loop type automobile sensing device according to an embodiment.

Referring to FIG. 8, a loop type automobile sensing device 300 includes differential loop coils 301 and 302, an inductance evaluation unit 304, and a communication unit 305. The inductance evaluation unit 304 is configured to receive, from the differential loop coils 301 and 302, electrical variations induced by an automobile to improve the automobile sensing sensitivity using a characteristics difference between the electrical variations. The communication unit 305 transmits a vehicle sensing result evaluated from the inductance evaluation unit 304. The differential loop coils 301 and 302 are electrically connected to the inductance evaluation unit 304 through loop connection wires 303. Power for operating the loop type automobile sensing device 300 is supplied through a power line 106 from the outside. The communication unit 305 is connected to a communication line for transmitting an automobile sensing result.

Accordingly, since power is stably supplied, the stability of the device is secured. In addition, the reliability of communication performance is secured through wired communication.

When the loop type automobile sensing device is provided in plurality, the loop type automobile sensing devices employ a wired structure as illustrated in FIG. 8, thereby reducing install and maintenance costs.

Figure 9:
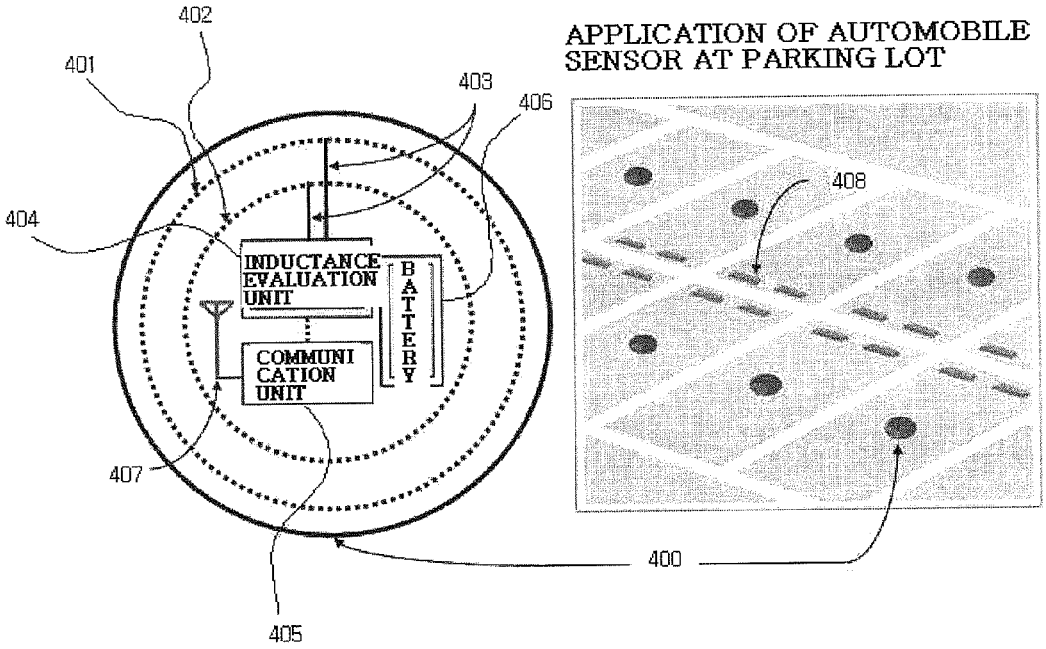
FIG. 9 is a schematic view illustrating configuration and application of a wireless loop type automobile sensing device according to an embodiment.

FIG. 9 is a schematic view illustrating configuration and application of a wireless loop type automobile sensing device, according to an embodiment.

Referring to FIG. 9, the loop type automobile sensing device includes differential loop coils 401 and 402, an inductance evaluation unit 404, a wireless communication unit 405, and an antenna 407 for wireless transmission. The inductance evaluation unit 404 is configured to receive, from the differential loop coils 401 and 402, electrical variations induced by an automobile to improve the automobile sensing sensitivity using a characteristics difference between the electrical variations. The wireless communication unit 405 transmits a vehicle sensing result evaluated from the inductance evaluation unit 404. A battery 406 is provided to supply operation power for operating the loop type automobile sensing device without an external power source. The differential loop coils 401 and 402 are electrically connected to the inductance evaluation unit 404 through loop connection wires 403.

When it is difficult to form a loop type automobile sensing device in a wired structure, or when an install process should be simplified, a wireless structure is applied to reduce install costs and to simplify an install process.

Figure 10:
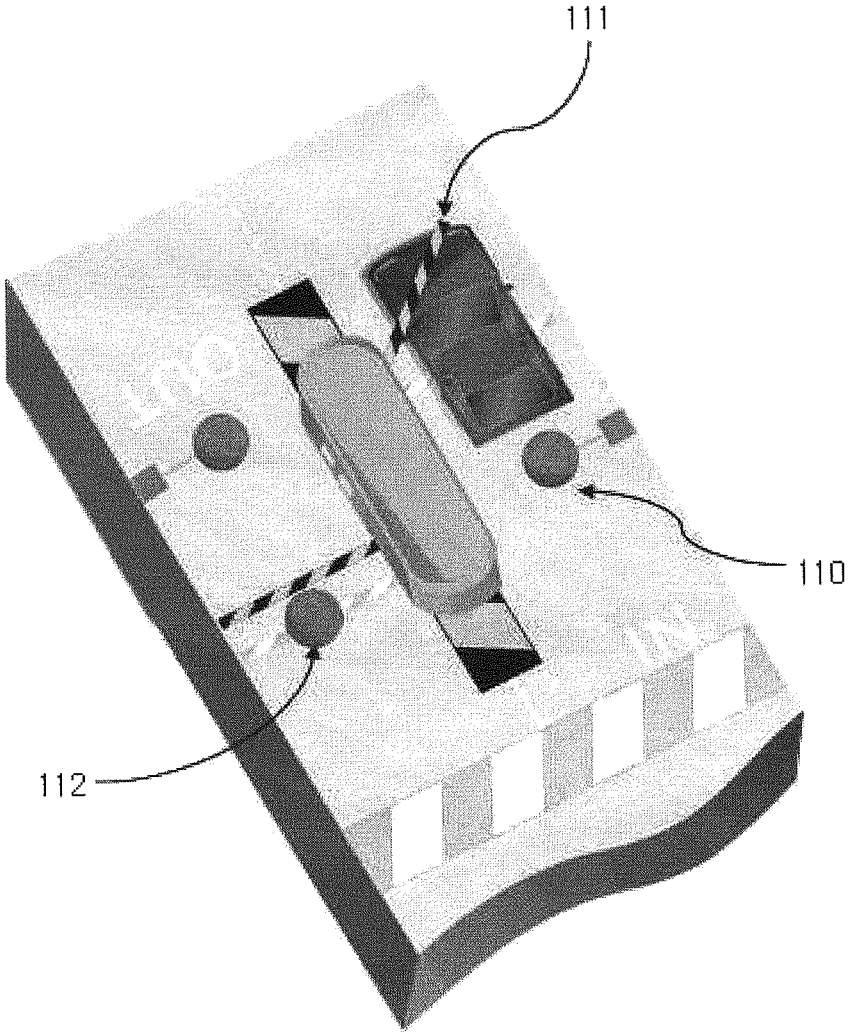
FIG. 10 is a schematic view illustrating a loop type automobile sensing device used as an entrance automobile sensing device of an entrance control system at a parking lot, according to an embodiment.

FIG. 10 is a schematic view illustrating a loop type automobile sensing device used as an entrance automobile sensing device 110 of an entrance control system at a parking lot, according to an embodiment. The loop type automobile sensing device according to the present invention is used as an automobile sensing member of an automatic cutoff device that uses a crossing gate 111 installed at a gateway of a parking lot to prevent a person from using the parking lot without permission, or to collect the parking fee of an automobile.

A floor at a gateway of a parking lot is cut and a loop coil is embedded in the floor, so that an automobile, entering a parking lot, is sensed to inform the crossing gate 111 of automobile entry or a ticket dispenser (not shown) automatically dispenses a ticket. In this case, the loop type automobile sensing device according to the present invention can be used as the entrance automobile sensing device 110, thereby reducing install costs and providing convenience.

In addition, the loop type automobile sensing device according to the present invention may be installed under the crossing gate 111 to be used as a crossing bar malfunction prevention sensing device 112 that prevents a crossing bar from hitting a moving automobile.

Figure 11:
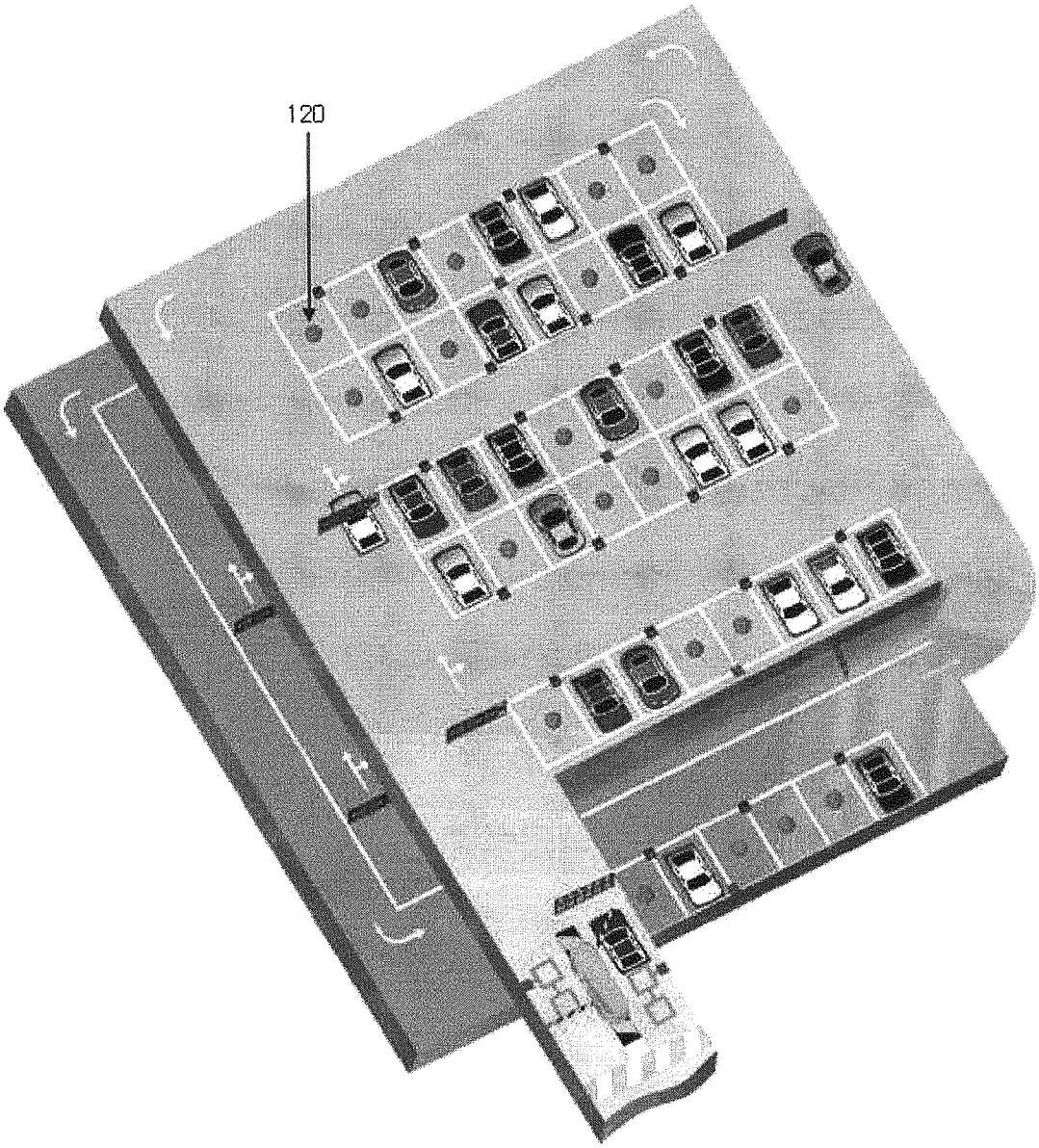
FIG. 11 is a schematic view illustrating a loop type automobile sensing device used as a parking surface automobile sensor of a parking information system according to an embodiment.

FIG. 11 is a schematic view illustrating a loop type automobile sensing device used as a parking surface automobile sensor of a parking information system according to an embodiment.

In the related art, to apply loop type automobile sensing devices to a parking information system, all positions of a parking lot where sensors are installed should be cut and loop coils should be embedded in the cut positions. However, since the loop type automobile sensing device according to the present invention is conveniently installed at a parking surface, the loop type automobile sensing device according to the present invention provides a more improved appearance than coils installed in cut positions, and reduces install costs.

Figure 12:
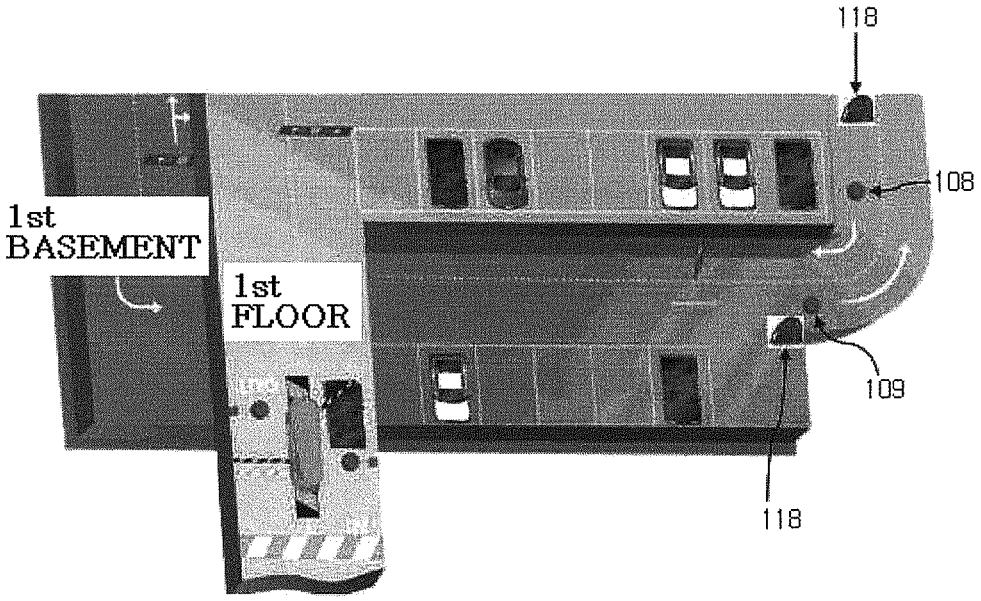
FIG. 12 is a schematic view illustrating a loop type automobile sensing device used as an automobile sensor installed at a connection between floors of a parking lot, according to an embodiment.

FIG. 12 is a schematic view illustrating a loop type automobile sensing device used as an automobile sensor installed at a connection between floors of a parking lot according to an embodiment. When an automobile moves between floors of a parking lot, the loop type automobile sensing device senses whether an automobile comes from the opposite sides, and warns the automobile moving between the floors.

In the related art, to prevent colliding of an automobile moving upward with an automobile moving downward between floors of a multi-level parking lot, a warning lamp 118 is provided to inform the automobile that an opposite automobile enters a connection of the floors. To use the warning lamp 118 as described above, the road between floors is cut and a loop coil is embedded in the cut road. However, installing of the loop type automobile sensing device according to the present invention is more convenient and provides a more improved appearance than the embedding of the loop coil in the cut road. Furthermore, install costs are significantly reduced.

Figure 1:
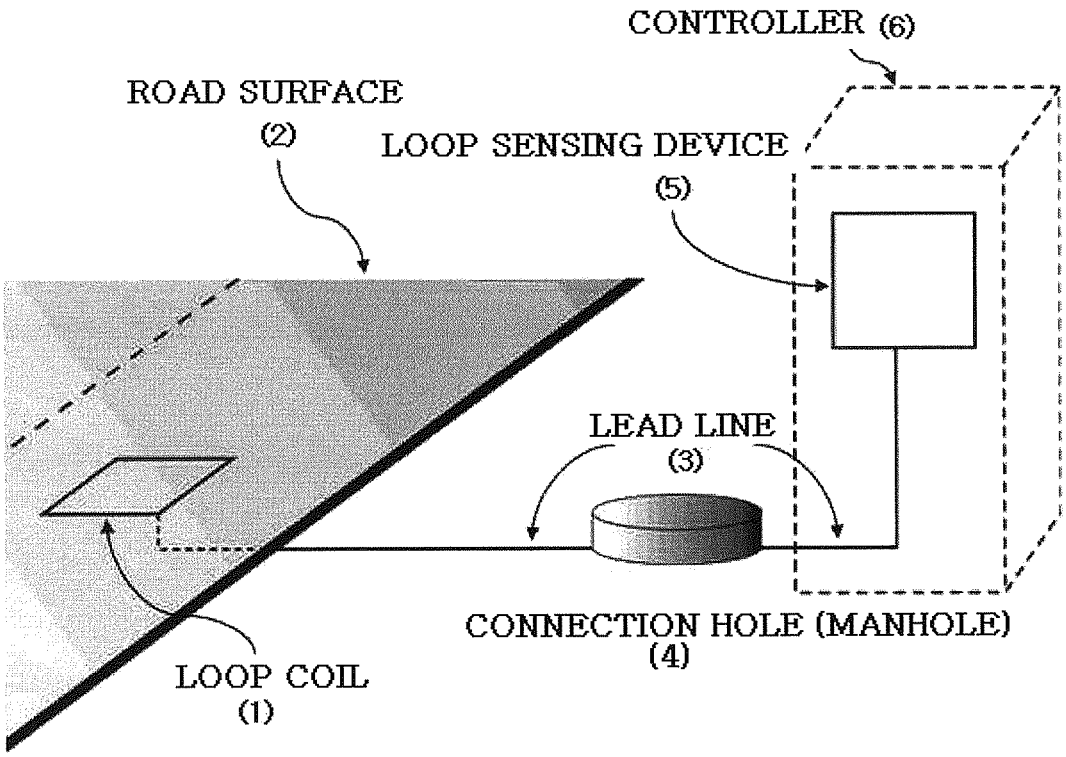
FIG. 1 is a schematic view illustrating a related art loop type automobile sensing device.
Figure 2:
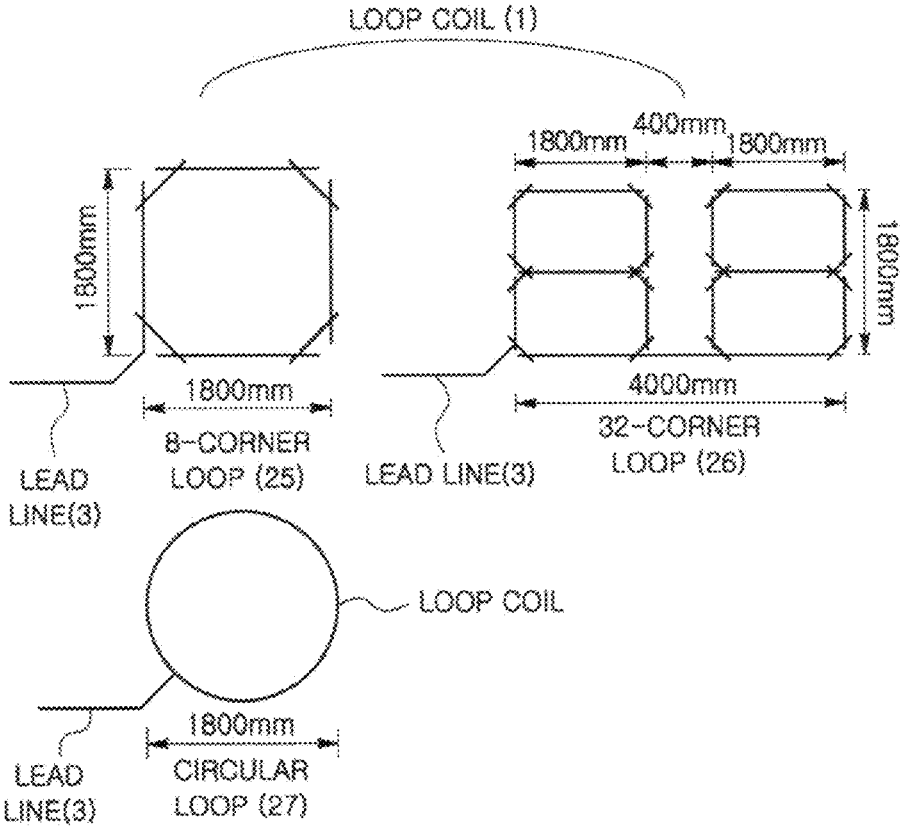
FIG. 2 is a schematic view illustrating shapes and structures of related art loop coils.
Figure 3A:
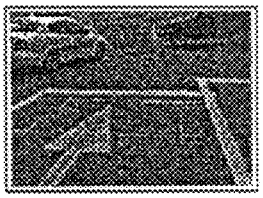
FIGS. 3*a* through 3*f* are images illustrating a process of installing a related art loop coil.
Figure 3B:
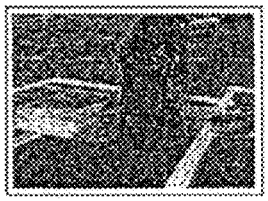
Figure 3C:
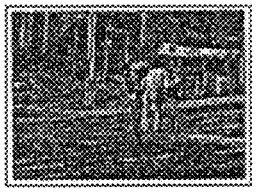
Figure 3D:
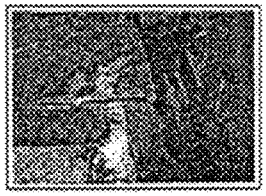
Figure 3E:
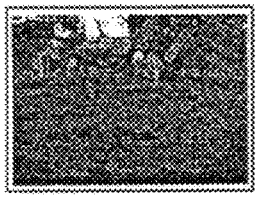
Figure 3F:
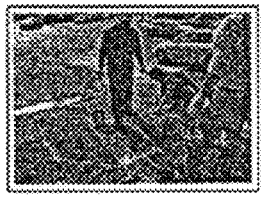
Figure 4:
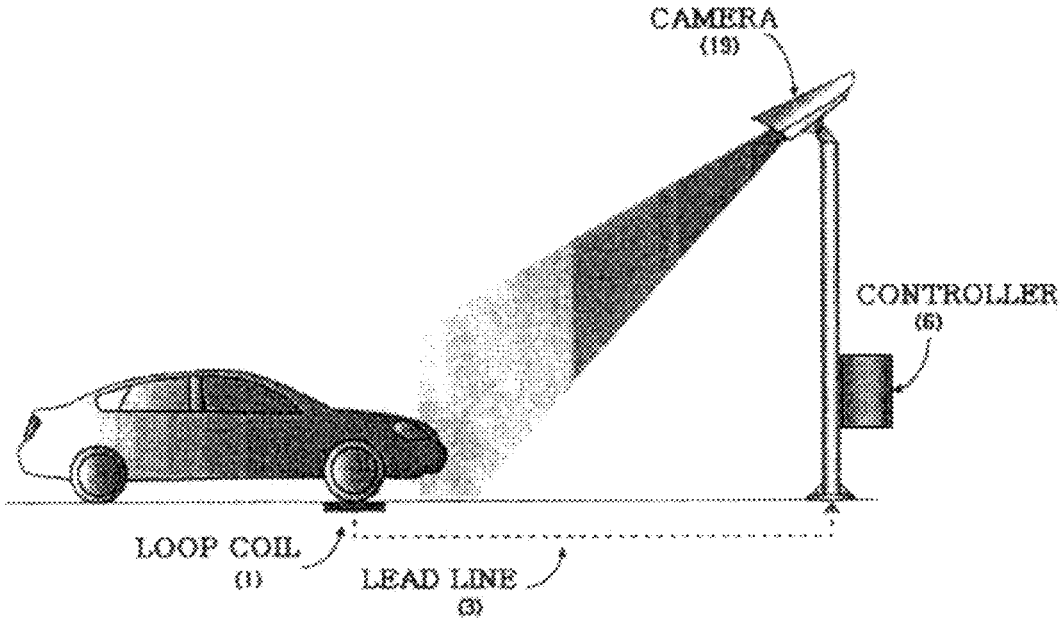
FIG. 4 is a schematic view illustrating an automobile photographing system using a related art loop type automobile sensing device.
Figure 5:
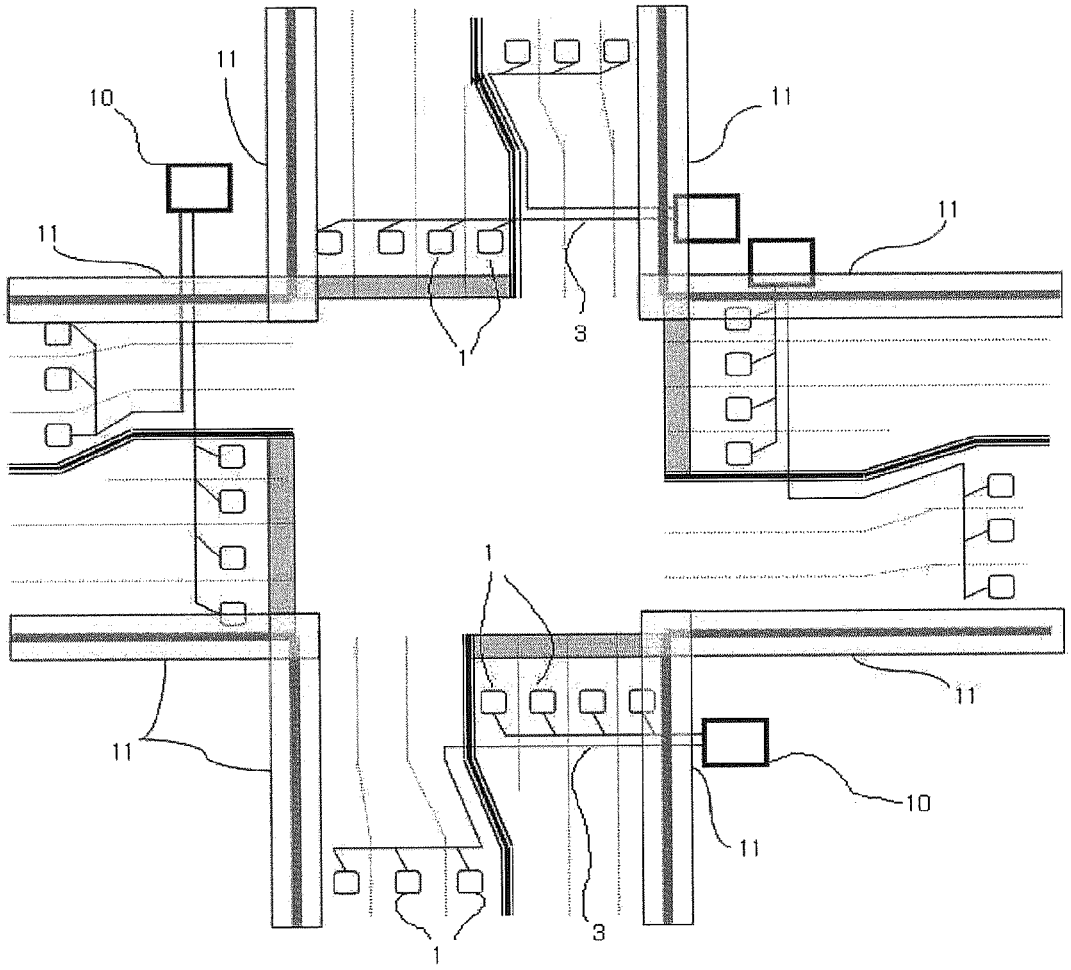
FIG. 5 is a schematic view illustrating limitations of a related art loop type automobile sensing device.

The loop type automobile sensing device according to the present invention may be used as an automobile recognition sensor member that senses an automobile to photograph the automobile (refer to FIG. 4).

A loop type automobile sensing device is widely used as an automobile photographing sensor that is applied to a parking control system, license number recognition, criminal vehicle detection system, signal/speed violation vehicle detection system, delinquent vehicle detection system, a bus lane violation detection system, and a toll gate nonpayment prevention system.

When the automobile sensing device according to the present invention is used for the above systems, the automobile sensing device is easily installed to a road, and a more improved appearance is provided than a case where a loop coil is installed in a cut road. In addition, install costs can be significantly reduced through wireless communication.

Figure 13:
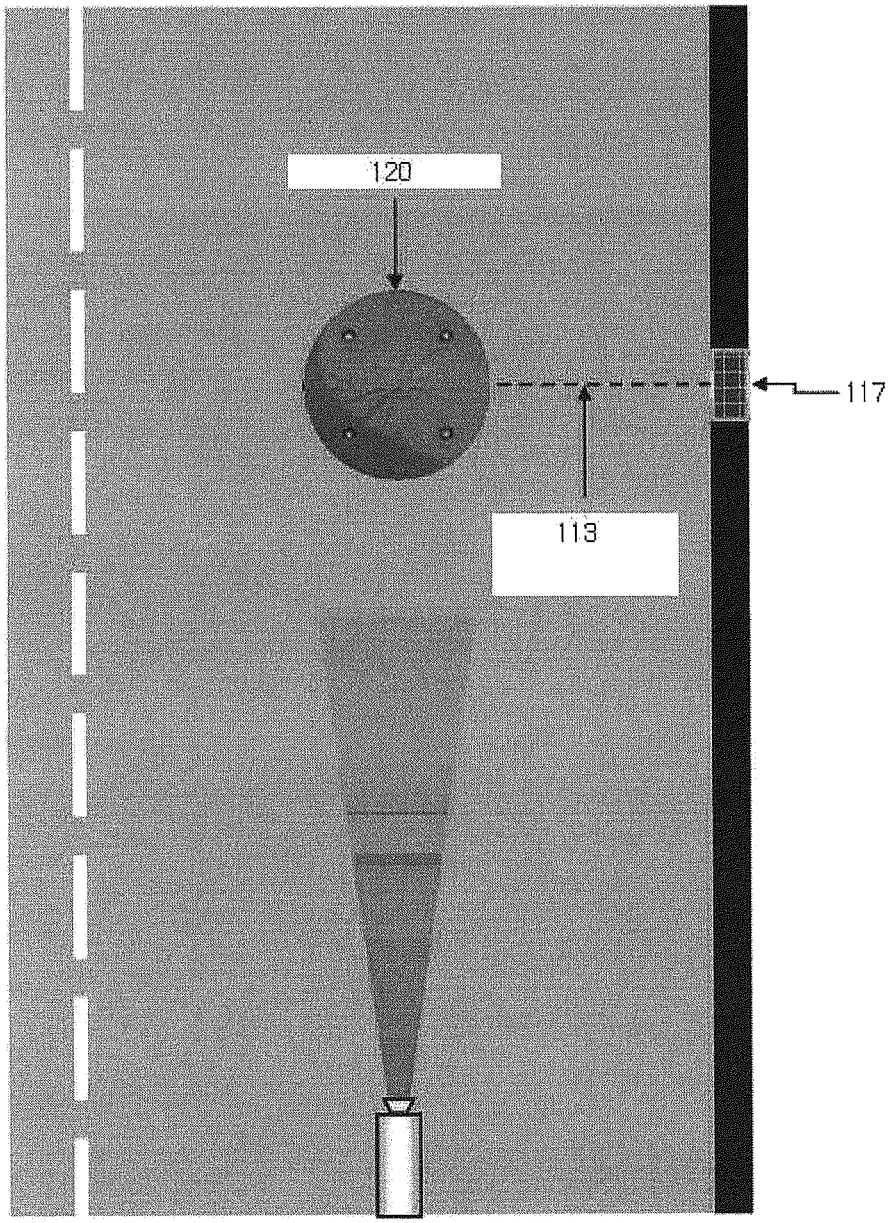
FIG. 13 is a schematic view illustrating a loop type automobile sensing device used as an automobile sensor using a photovoltaic device, according to an embodiment.

FIG. 13 is a schematic view illustrating a loop type automobile sensing device used as an automobile sensor using a photovoltaic device, according to an embodiment. The photovoltaic device is used to supply power for operating a device installed outdoor.

Referring to FIG. 13, the loop type automobile sensing device is attached to or embedded in a road surface, the photovoltaic device 117 including a solar panel is attached to a dividing line of a road or to a safety zone, and the photovoltaic device 117 is connected to the loop type automobile sensor 120 through the power connection wire 113 to supply power.

The loop type automobile sensing device includes a battery for operating the loop type automobile sensing, and a storage member that receives power from the photovoltaic device and that stores the power.

Figure 14:
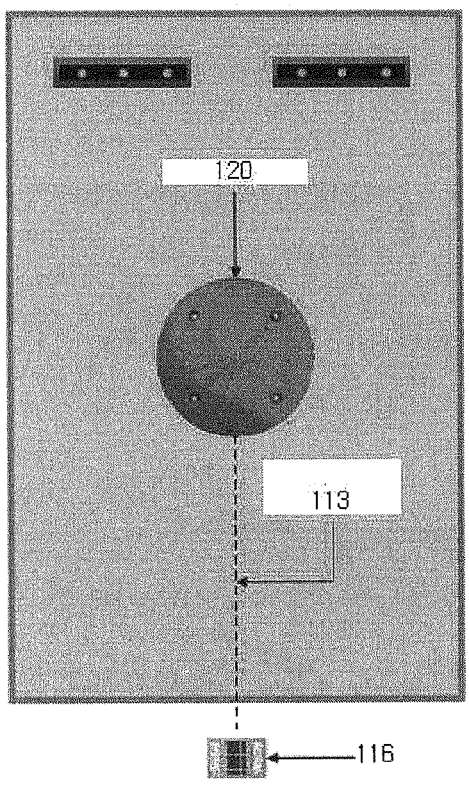
FIG. 14 is a schematic view illustrating a parking surface automobile information system with a loop type automobile sensing device used as an automobile sensor using a photovoltaic device, according to an embodiment.
Figure 14:
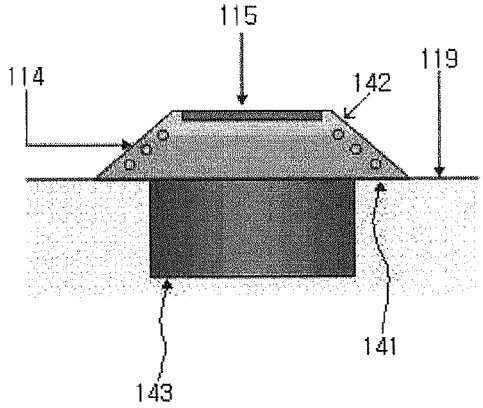

FIG. 14 is a schematic view illustrating a parking surface automobile information system with a loop type automobile sensing device used as an automobile sensor using a photovoltaic device, according to an embodiment. The loop type automobile sensing device constitutes the parking information system.

The parking information system includes an automobile sensor and a parking state display device in which the loop type automobile sensing device may be applied.

Referring to FIG. 14, an embedded type photovoltaic display device including a photovoltaic device (not shown) for supplying power to the automobile sensor, and a parking state display 114 formed integrally with the photovoltaic device. The embedded type photovoltaic display device is embedded in a position that a driver, moving in a parking lot, easily recognizes. The embedded type photovoltaic display device is connected to the automobile sensing device through the power/signal connection wire 113 for supplying power and transmitting a signal of the parking state display device. The loop type automobile sensing device, as an automobile sensor, constitutes the parking information system.

The loop type automobile sensing device includes a battery for operating the loop type automobile sensing device, and a storage member that receives power from the embedded type photovoltaic display device and stores the power.

The embedded type photovoltaic display device includes the solar panel 115 using solar energy to generate electricity, and the parking state display 114 informing a driver, moving in a parking lot, of a parking state. The embedded type photovoltaic display device may be embedded in a floor of a parking lot.

While this invention has been particularly shown and described with reference to preferred embodiments thereof, it will be understood by those skilled in the art that various changes in form and details may be made therein without departing from the spirit and scope of the invention as defined by the appended claims.

[Industrial Applicability]

A loop type automobile sensing device including a small loop coil according to the present invention can be applied to any field that employs a related art loop type automobile sensing device provided with a loop coil and a connection wire.

In addition, the loop type automobile sensing device may be fixed to the position of a road where a related art loop coil is installed, and simplify a complicated install process, and thus, can be applied to any field that employs a related art loop type automobile sensing device provided with a loop coil and a connection wire.

The invention claimed is:

1. An integral loop type automobile sensing device comprising:

a body providing an appearance;

two or more differential loop coils having closed curves in the body and arranged in an up-and-down direction to have different distances from a lower structure of a target automobile;

an inductance evaluation unit configured to receive, from the loop coil, electrical variation induced by the automobile to increase automobile sensing sensitivity; and a communication unit configured to receive an automobile sensing result from the inductance evaluation unit and to transmit the result.

2. The integral loop type automobile sensing device of claim 1, wherein at least one of the loop coils is disposed along a periphery surface in the body to have a maximum closed curve.

3. The integral loop type automobile sensing device of claim 1, wherein the inductance evaluation unit is configured to increase the automobile sensing sensitivity using a variation difference between the loop coils arrayed in the up-and-down direction to have different distances from a lower structure of a target automobile.

4. The integral loop type automobile sensing device of claim 1, wherein the loop coil has a size of 900 mm or less, and wherein the size indicates a diameter of the loop coil or a length of a smallest side of the loop coil when the loop coil is substantially circular or polygonal, respectively.

5. The integral loop type automobile sensing device of claim 1, further comprising a battery power unit to supply power for operating the integral loop type automobile sensing device.

6. The integral loop type automobile sensing device of claim 1, wherein the communication unit performs one-to-one communication or one-to-many communication through wired communication or wireless communication.

7. The integral loop type automobile sensing device of claim 1, wherein the body is formed in a single piece.

8. The integral loop type automobile sensing device of claim 7, wherein the body is fixed to a road surface through a screw member or a nail member.

9. The integral loop type automobile sensing device of claim 7, wherein the body is embedded in a road such that an upper surface of the body is flush with a road surface, and then the body is fixed to the road through a screw member or a nail member.

10. The integral loop type automobile sensing device of claim 1, wherein the body comprises two pieces that are removable from each other.

11. The integral loop type automobile sensing device of claim 10, wherein the body is fixed to a road surface through a screw member or a nail member.

12. The integral loop type automobile sensing device of claim 10, wherein the body is embedded in a road such that an upper surface of the body is flush with a road surface, and then the body is fixed to the road through a screw member or a nail member.

13. The integral loop type automobile sensing device of claim 1, wherein the integral loop type automobile sensing device receives power through a power connection wire from a photovoltaic device that includes a solar panel installed at a dividing line of a road or at a safety zone.

14. The integral loop type automobile sensing device of claim 1, further comprising a photovoltaic device that converts photo energy, supplied through a solar panel installed to an upper part of the body, into electrical energy to supply power.

15. A parking information system using a plurality of integral loop type automobile sensing devices as automobile sensors disposed at a parking lot floor, each including:

a body providing an appearance;

two or more differential loop coils having closed curves in the body and arranged in an up-and-down direction to have different distances from a lower structure of a target automobile;

an inductance evaluation unit configured to receive, from the loop coil, electrical variation induced by the automobile to increase automobile sensing sensitivity; and a communication unit configured to receive an automobile sensing result from the inductance evaluation unit to transmit the result, the parking information system comprising a control unit configured to detect parking and moving state of an automobile according to a signal transmitted from the automobile sensors, to control operations of a plurality of cameras, warning lamps, and display devices installed to a parking lot, and to notify parking information and automobile movement information.

16. The parking information system of claim 15, wherein at least one of the loop coils is disposed along a periphery surface in the body to have a maximum closed curve.

17. The parking information system of claim 15, wherein the inductance evaluation unit is configured to increase the automobile sensing sensitivity using a variation difference between the loop coils arrayed in the up-and-down direction to have different distances from a lower structure of a target automobile.

18. The parking information system of claim 15, further comprising a battery power unit to supply power for operating the integral loop type automobile sensing device.

19. The parking information system of claim 15, wherein the communication unit performs one-to-one communication or one-to-many communication through wired communication or wireless communication.

20. The parking information system of claim 15, wherein the integral loop type automobile sensing device receives power through a power connection wire from a photovoltaic device that includes a solar panel installed at a dividing line of a road or at a safety zone.

21. The parking information system of claim 15, wherein the integral loop type automobile sensing device comprises a display unit installed at a side of the body to display presence of an available parking space.

22. The parking information system of claim 15, wherein the integral loop type automobile sensing device comprises a photovoltaic device that converts photo energy, supplied through a solar panel installed to an upper part of the body, into electrical energy to supply power.

23. The parking information system of claim 15, wherein the integral loop type automobile sensing device comprises:

a display unit installed at a side of the body to display presence of an available parking space; and a photovoltaic device that converts photo energy, supplied through a solar panel installed to an upper part of the body, into electrical energy to supply power.

* * * * *